US005591272A

United States Patent [19]

Hummer

[11] Patent Number: 5,591,272

[45] Date of Patent: Jan. 7, 1997

[54] METHOD FOR CLEANING AN OIL TANK

[75] Inventor: Jan S. Hummer, Charlottenlund, Denmark

[73] Assignee: Toftejorg Technology ApS, Ishøj, Denmark

[21] Appl. No.: 508,398

[22] Filed: Jul. 31, 1995

Related U.S. Application Data

[63] Continuation of Ser. No. 146,194, filed as PCT/DK93/00095 Mar. 19, 1993, abandoned.

[30] Foreign Application Priority Data

Mar. 17, 1992 [DK] Denmark ..... 0357/92

[51] Int. Cl.[6] ..... B08B 3/02; B08B 3/10; B08B 9/00; B08B 9/093

[52] U.S. Cl. ..... 134/10; 134/13; 134/19; 134/22.1; 134/22.12; 134/22.18; 134/24; 134/26; 134/40

[58] Field of Search ..... 134/10, 22.1, 26, 134/40, 13, 19, 24, 22.18, 22.12, 166 R, 167 R, 107, 169 R, 198, 168 R

[56] References Cited

U.S. PATENT DOCUMENTS

| | | | |
|---|---|---|---|
| 3,121,027 | 2/1964 | Galanor | 134/10 |
| 4,466,154 | 8/1984 | Urbani | 15/302 |
| 4,592,786 | 6/1986 | Williams et al. | 134/22.18 |
| 5,078,799 | 1/1992 | Matter et al. | 134/22.18 |
| 5,085,242 | 2/1992 | Ripley et al. | 137/13 |

*Primary Examiner*—Zeinab El-Arini
*Attorney, Agent, or Firm*—Watson Cole Stevens Davis, P.L.L.C.

[57] ABSTRACT

A method for cleaning an oil tank containing residues wherein the oil residues are fluidized by a fluidizing agent and are discharged from the tank in liquid state and are separated into fractions, and wherein the fluidizing agent primarily used is a portion of the oil residues discharged from the tank which, following purification and heating, is recycled to the tank and distributed by spraying above the layer of oil residues.

5 Claims, 2 Drawing Sheets

METHOD FOR CLEANING AN OIL TANK

CROSS REFERENCE TO RELATED APPLICATION

This is a continuation of application Ser. No. 08/146,194, filed Nov. 17, 1993, now abandoned, which derived from PCT/DK93/00095, filed Mar. 19, 1993.

BACKGROUND OF THE INVENTION

1. Field of the Invention

The present invention relates to a method for cleaning an oil tank containing oil residues while simultaneously exploiting said oil residues, wherein the oil residues are fluidised to form a liquid mixture and wherein the liquid mixture thus formed is discharged from the tank and subjected to a treatment to separate the mixture into fractions.

2. The Prior Art

During the storage of oil products, such as crude oil, fuel oil and other refined oils, in oil tanks, a minor portion of the oil is precipitated. The precipitated material, the amount of which depends on the oil product type and origin, is deposited on the bottom and the sides of the oil tank and in time it will form a comparatively thick sludge layer in the tank. Especially in tanks used for the storage of crude oil, the layer thus formed will contain components other than hydrocarbons. Thus, there may be considerable amounts of water, sand, loose rust and sludge present in the layer.

When an oil tank containing such a sludge layer has been emptied, there is usually a water layer below the layer, and this water layer is discharged by pumping before the removal of the oil residue layer is initiated. The oil residue layer may be so solid that the removal thereof previously had to be carried out by manual or mechanical digging or by adding a major amount of another oil which was set in forceful motion by means of stirrers so as to suspend the oil portion of the sludge layer in the oil. This was done to facilitate the actual cleaning, which was performed manually, optionally with mechanical assistance, e.g., by use of sludge extractors or the like equipment.

U.S. Pat. No. 5,085,242 discloses a method of the type described above. In this known method a heating medium is introduced below the liquid surface through a manhole in an oil storage tank, which heating medium is preferably immiscible with oil and is preferably water in such an amount and at such a temperature that the oil residue in the tank melts and a liquid layer consisting of a lower water phase and an upper oil phase is formed at the bottom of the tank.

The removal of oil is preferably effected by positioning a floating pump in the tank, the inlet of the pump being located above the interface between the water phase and the oil phase. The oil is discharged by pumping through a second manhole in the oil tank and is introduced into a holding tank where heat is applied and it is stirred to prevent it from solidifying. While in the holding tank, water is separated off before the melted oil product, after renewed heating, is subjected to various after-treatments, such as filtration, decantation and centrifugation for separating off solid components, water residues and other undesired components. Following the discharge by pumping of the major part of the oil phase, the lower water phase and the solid particles precipitated at the bottom of the tank are discharged in a conventional manner, i.e., manually and/or mechanically.

According to a preferred embodiment of the known method, the heating medium used, as mentioned preferably water, is pumped out of the tank, and after filtration and renewed heating, it is recycled to the tank.

SUMMARY OF THE INVENTION

The method according to the invention is characterized in primarily using a portion of the fluidised mixture discharged from the tank as a fluidising agent, the fluidised mixture being purified prior to recycling to the oil tank, and in distributing the mixture by spraying above the liquid surface of the oil tank by use of spraying means which are arranged so as to spray the interior of the oil tank.

The invention is based on the discovery that several technical advantages are obtained by using a portion of the discharged oil product as a fluidising agent instead of a separate heating medium and by spraying the oil product above the liquid surface rather than below the liquid surface as it is usually done in recycling systems. Firstly the volume of the polluted material is substantially reduced and secondly the use and heating of a separate heating medium is avoided. Furthermore the problems of re-separating the heating medium from the fluidised oil product and carrying out a separate removal of the heated oil product from the tank are avoided. As a result of the way in which the mixture is reintroduced, an efficient physical impact on the surfaces to be cleaned and/or treated is obtained.

Also, the use of a separate heated holding tank can be avoided.

Additionally, the elimination of a separate heating medium results in a simplification of the subsequent processing of the fluidised oil product to form useful oil products.

The above technical advantages manifest themselves, i.e., in a reduction of the time it takes to clean the oil tank. For example, a tank having a volume of 50–80,000 $m^3$ is cleaned in 24–48 hours, whereas the method known from GB 2,227,648 allegedly requires 4–8 days for the emptying process and 10–20 days for the subsequent cleaning of the interior. By conventional manual or manual/mechanical cleaning, the cleaning time typically is 30–90 days.

The following description of the invention is based on the discovery that the fluidisation of the oil residues is effected by heating thereof and that the fluidising agent is consequently a purified portion of the liquid mixture extracted from the tank.

However, it should be noted that the fluidisation may be completely or partially obtained in other ways, e.g., by dilution with a minor amount of a viscosity reducing agent, such as diesel oil, i.e., an amount which as a maximum corresponds to the amount of oil residues present in the tank, or by physical impact imparted to the oil residue layer.

Thus, it has been shown that the viscosity of the oil residue layer is often changed to such an extent that it becomes liquid if it is subjected to vibrations or other movements. For example, the layer may be partially fluidised simply by directing heavy liquid jets against said layer.

Before initiating the removal of the precipitated oil residues from the oil tank, it is necessary to apply heat to the area from which the removal of the liquid mixture is to be carried out. This may be effected by introducing heated oil into the area, e.g., oil from a previous oil tank cleaning operation. Alternatively, the oil tank may comprise integral means for indirect heating of part of the tank. Such indirect heating means may for example be electric heating cables mounted around a conduit for pumping out a liquid oil product.

When a suitable amount of liquid oil product has been formed in the tank, the oil is discharged from the tank by pumping and subjected to purification, and following an optional heating, it is recycled to the tank through the spraying means arranged in the tank and is used as a heating medium for the heating, melting and fluidisation of further oil residues.

Following a suitable period of time when a suitably large amount of liquid oil product has been formed, only a portion thereof is recycled to the oil tank and the remainder is processed.

As the tank cleaning process progresses and the amount of precipitated oil product in the tank is reduced, the portion of the liquid oil product which is recycled is reduced and the recycling is discontinued when the oil tank contains only insignificant amounts of oil product.

The liquid mixture is preferably reheated to a temperature of from 50° to 95° C. and in particular from 65° to 90° C.

Heating of the precipitated oil residue to a temperature comprised within the range given above results in a liquid mixture having a viscosity suitable for discharge by pumping and comprised within the interval of 1–150 centistokes.

According to a preferred embodiment of the method according to the invention the liquid mixture discharged from the oil tank by pumping is purified prior to reheating and recycling to the oil tank. This may e.g., be effected by initially introducing it into a precipitation tank to precipitate solid matter, such as sand, rust residues and the like and then passing it through a separator to separate water from the oil.

The purification may also be carried out in other ways, e.g., by filtration, decantation, centrifugation or by treatment in a hydrocyclone.

The recycled liquid mixture is preferably distributed in the oil tank by spraying so that the sides as well as the bottom of the oil tank are treated.

For that use one or more rotating nozzles are (is) preferably utilized, the nozzles gradually changing planes of rotation in such a manner that all portions of the interior of the tank are hit by the liquid jet(s) and are thus cleaned of oil residues.

It has been found that the most effective cleaning is obtained when the hot liquid is sprayed at a pressure of below 25 bar. By use of such comparatively low pressure and of suitably designed nozzles, liquid jets are produced having a sufficiently high intertia to effect effective release and fluidisation of the oil residues present in the tank when the they hit the oil residues and the interior of the tank.

According to a further preferred embodiment of the method according to the invention the cleaning of the oil tank with the heated oil residue is followed by a cleaning of the sides and bottom of the tank with a rinsing agent, preferably hot water, which is sprayed through the same spraying means which were used during the fluidisation process.

The oil product discharged from the oil tank and purified may be used as fuel, as additive for addition to other oil products or as starting material for a thermal cracking process wherein hydrocarbons of a lower molecular weight and a lower boiling point are produced from the comparatively high molecular hydrocarbons contained in the oil residue.

The invention also relates to an apparatus for carrying out the method described above. The apparatus according to the invention comprises means for introducing a fluidising agent into the oil tank to form of a liquid mixture from the precipitated oil residues, means for discharging the liquid mixture from the tank, and means for treating the liquid mixture to separate it into fractions and the apparatus is characterized in that it further comprises means for separating off a portion of the liquid mixture discharged from the tank, means for purifying the separated portion of the liquid mixture and means for recycling the portion of the separated portion of the liquid mixture to the oil tank.

A particularly preferred embodiment of the apparatus according to the invention further comprises means for heating the separated portion of the extracted liquid before it is recycled to the oil tank and sprayed above the liquid surface.

According to a further preferred embodiment of the apparatus the means for treating the liquid mixture to remove undesired substances comprise a precipitation tank for the separation of solid matter and a separator for the separation of water, such means are preferably arranged on the upstream side of the means for separation and recycling a portion of the liquid mixture to the oil tank.

The above-mentioned separator conveniently comprises a fibrous mat arranged in a tank with means for introducing an aqueous mixture to the one side of the fibrous mat and means for removing a mixture relieved of water from the opposite side of the mat. Such a separator presents the advantage of being very simple, inexpensive and reliable.

The invention will now be described in detail with reference to the accompanying drawings.

DETAILED DESCRIPTION OF THE PREFERRED EMBODIMENTS

Figure 1:
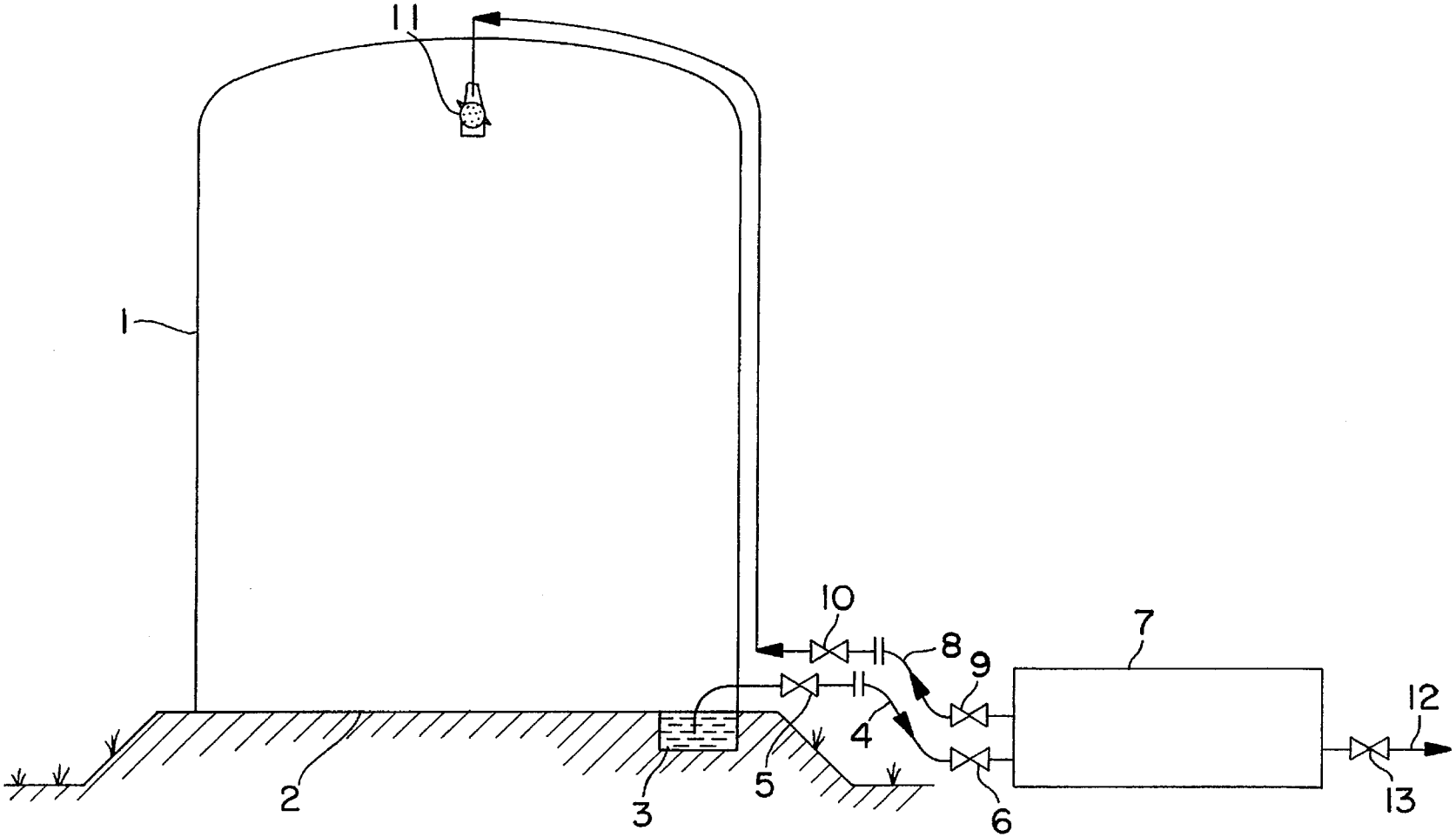
FIG. 1 is a schematical vertical sectional view of an oil tank connected to an apparatus according to the invention.

In FIG. 1, 1 denotes an oil tank having a bottom 2 comprising an oil sump 3 connected to an oil discharge conduit 4. The discharge conduit 4 wherein valves 5 and 6 are arranged is connected to an apparatus 7 according to the invention.

Through a further conduit 8 wherein valves 9 and 10 are arranged, the apparatus 7 is connected to liquid distribution means 11, e.g., in the form of rotatable nozzles, the means 11 being arranged so that the liquid flowing out of them may be caused to spray all parts of the interior of the tank 1.

Furthermore, the apparatus 7 comprises a discharge conduit 12 for purified oil product and a valve 13 mounted in the conduit 12.

Figure 2:
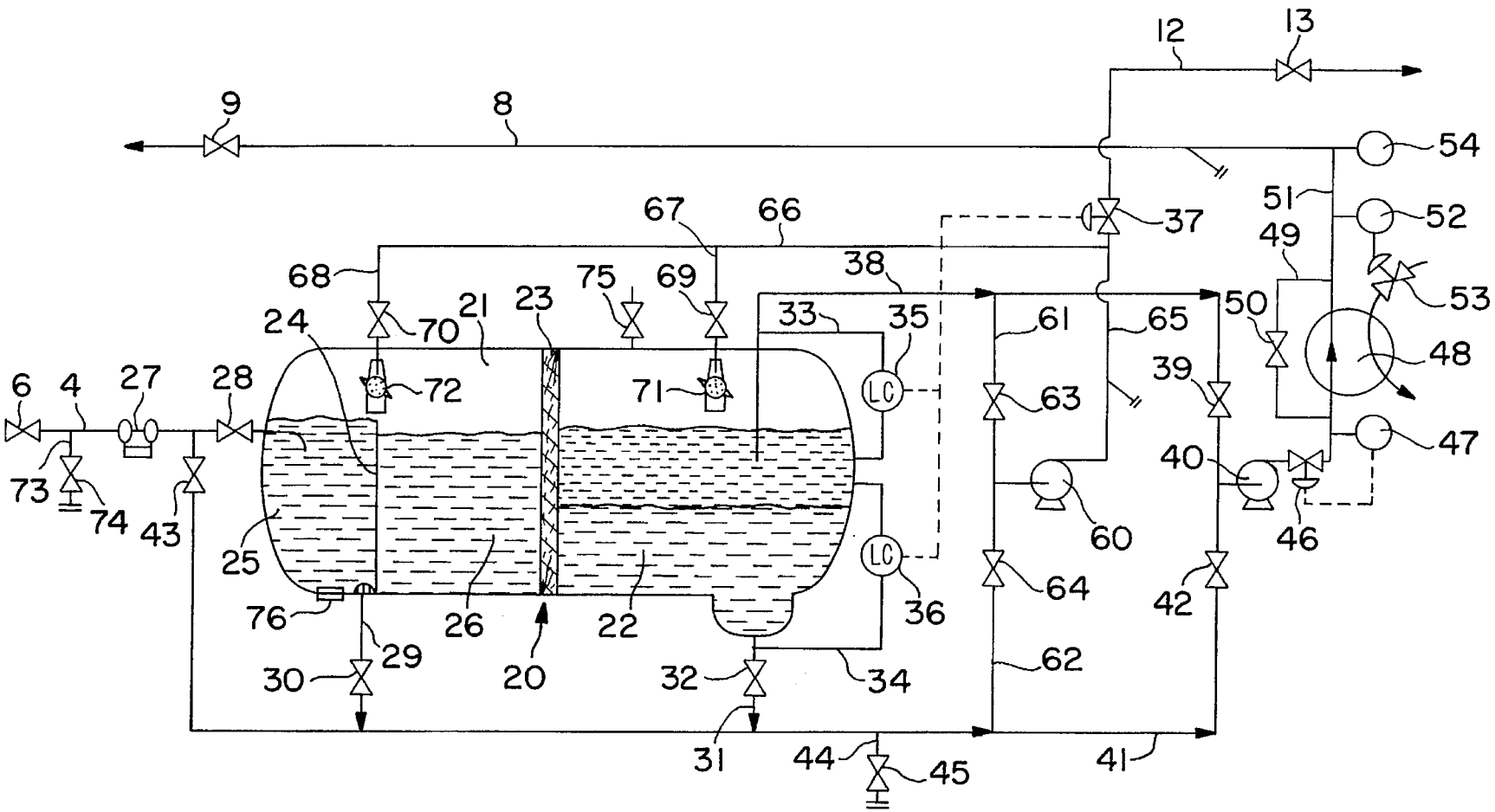
FIG. 2 is a flow diagram for the apparatus according to the invention and shown schematically in FIG. 1.

The apparatus shown in FIG. 2 comprises a tank 20 divided into two chambers 21 and 22 by a partition wall 23 in the form of a mineral fibre board. The chamber 22 is divided into two compartments 25 and 26 by means of an additional partition wall 24 which acts as an overflow. As will appear from FIG. 2 the oil discharge conduit 4 and the valve 6 arranged therein are connected to the compartment 25 via a pump 27, such as a diaphragm pump, and an additional valve 28. The bottom of the compartment 25 is connected to a conduit 29 with a valve 30 and the bottom of the chamber 22 is in a similar manner connected to a second conduit 31 with a valve 32.

The chamber 22 is further connected to pipes 33 and 34 wherein level controls 35 and 36, respectively, are incorporated, these valves being both electrically coupled to a valve 37 which will be described in further detail below.

Moreover, the chamber 22 is connected to a conduit 38 having a free end which is arranged in the upper part of the chamber 22. Through a valve 39 the conduit 38 is connected to the inlet of a circulation pump 40. The inlet of the circulation pump 40 is connected to a further conduit 41 which through valves 42 and 43 is connected to the oil discharge conduit 4. The conduit 41 is connected to the conduits 29 and 31 and further comprises an outlet conduit 44 with a valve 45.

Through a pressure control 46 with a pressure sensor 47, the outlet of the circulation pump 40 is connected to the inlet of a heat exchanger 48 and a shunt conduit 49 with a valve 50. A conduit 51 to which there is coupled a sensor 52 which controls a control 53 for the supply of heating medium to the heat exchanger 48 and a manometer 54, connects the outlet of the heat exchanger 48 with the conduit 8 with the valve 9 arranged therein.

Through conduits 61 and 62 wherein valves 63 and 64, respectively, are arranged, the inlet of a pump 60 can be connected to the conduit 38 or the conduit 41.

The outlet of the pump 60 is connected to the valve 37 through a pipe 65, the outlet of the valve 37 being connected to the conduit 12 with the the valve 13.

The conduit 65 is also coupled to a recycling conduit 66 which through manifolds 67 and 68 with valves 69 and 70, respectively, is connected to nozzles 71 and 72, respectively, arranged in the chambers 21 and 22.

The apparatus shown further comprises a branch conduit 73 with a valve 74 provided on the conduit 4 and a ventilation valve 75 which is connected to the tank 20.

Finally the tank 30 comprises a bottom valve 76 for the discharge of precipitated solid particles.

The apparatus shown operates as follows:

When initiating the method for the removal of oil residues precipitated on the bottom 2 of the tank 1, heat is to be supplied to the area around the sump 3. This may be effected by introducing a portion of heated oil through the liquid distribution means 11 or by using electrical heating means arranged in or in the vicinity of the sump 3.

When a suitable amount of melted oil residue has been formed by such initial heat supply or in any other way, the residue is pumped into the compartment 25 in the tank 20 by means of the pump 27. In the compartment 25 a separation occurs as the solid particles, such as sand, loose rust, etc., are precipitated. The liquid relieved of such impurities overflows the upper edge of the wall 24 and enters the compartment 26.

The solid particles precipitated in the compartment 25 may be discharged through the bottom valve 76 and the heavy part of the liquid in the chamber 22 may be discharged through the conduit 29 and the valve 30.

The portion of the liquid entering the compartment 25 may be recycled to the tank 1 by means of the pump 40 following reheating in the heat exchanger 48.

From the chamber 26 the liquid passes through the mineral fibre board 23 into the chamber 22. During its passage through the board 23 a separation of the liquid into an upper oil phase and a lower water phase occurs.

By controlling the amount of water which, via the conduit 31, the conduits 41 and 62, the valve 64 and the pump 60, is conducted from the valve 32 to the chamber 22 and on through the valve 37 to the conduit 12, the level controls 35 and 36 ensure that a suitable balance between the two phases is maintained in the chamber 22.

Through the conduit 38 purified oil product is discharged from the chamber 22. A portion of the oil product thus discharged is passed through the heat exchanger 48 where it is reheated and further to the conduit 8 and from there back to the tank 1 where it is distributed over the inside of the tank by means of the liquid distribution means 11.

The pressure in the recycled hot liquid is regulated by means of the pressure control 46 with the pressure sensor 47. The pressure in the conduit 8 is preferably kept below 25 bar, and more preferably between 8 and 12 bar. As mentioned above, the use of such comparatively low pressures results in liquid jets with a particularly high cleaning effectiveness. Another portion of the discharged oil may be conducted to the conduit 8 through the valve 37 by means of the pump 60.

When all precipitated oil residues in the tank 1 have been melted the recycling of heated oil residue is discontinued, e.g., by closing the valve 39. When the valves 32 and 42 are subsequently opened the water may be discharged from the chamber 22 by pumping and the pumped-out water may, following passage through the pump 40 and the heat exchanger 48, be recycled to the tank 1 and be used therein as a rinsing agent.

Residual oil product may be removed from the tank 1 through the conduits 29 and 31 with valves 30 and 32, the pipe 41, the valve 43, the pump 27 and the drainage valve 45. Rinsing of the chambers 21 and 22 may also be effected by supplying liquid under pressure to the nozzles 71 and 72.

I claim:

1. A method of removing oil residues from a tank containing an oil-containing liquid and a layer of oil residues and for converting the oil residues into a purified oil product, said method comprising the steps of:

(a) spraying a heated oil residue-containing liquid a product against the oil residues located in the tank above a surface of oil-containing liquid therein to fluidize the oil residues and form a fluidized oil residue-containing liquid mixture within the tank;

(b) discharging said fluidized oil residue-containing liquid mixture from the tank;

(c) purifying a first portion of said fluidized oil residue-containing liquid mixture from step (b) to form a purified oil product;

(d) recovering said purified oil product from step (c);

(e) heating a second portion of said fluidized oil residue-containing liquid mixture from step (b) to form a heated oil residue-containing liquid mixture having a temperature sufficiently high to fluidize said oil residues in said tank; and (f) recycling said heated oil residue-containing liquid mixture from step (e) to step (a) to provide said heated, oil residue-containing product.

2. A method according to claim 1, wherein in step (e) said second portion is heated to a temperature of from 50° to 95° C.

3. A method according to claim 1, wherein in step (a) said heated oil residue-containing product is sprayed against the oil residues at a pressure of below 25 bar.

4. A method according to claim 1, including after step (f) a step of rinsing the tank with water.

5. A method according to claim 1, wherein in step (a) said heated oil residue-containing liquid product is sprayed through at least one rotating nozzle so as to impact all areas of the tank above the oil-containing liquid therein.

* * * * *

UNITED STATES PATENT AND TRADEMARK OFFICE

CERTIFICATE OF CORRECTION

PATENT NO. : 5,591,272

DATED : January 7, 1997

INVENTOR(S) : Jan S. HUMMER

It is certified that error appears in the above-indentified patent and that said Letters Patent is hereby corrected as shown below:

In heading item 63, replace "March 19, 1993" with --March 16, 1993--.

In column 1, line 9, replace "March 19, 1993" with --March 16, 1993--.

Signed and Sealed this

Tenth Day of June, 1997

Bruce Lehman

*Attest:*

BRUCE LEHMAN

*Attesting Officer*

*Commissioner of Patents and Trademarks*